US007117939B1

(12) United States Patent
Hawley et al.

(10) Patent No.: US 7,117,939 B1
(45) Date of Patent: Oct. 10, 2006

(54) PERCUSSION HAMMER BIT RETAINER APPARATUS

(76) Inventors: Gregory Dee Hawley, 4202 Old Christoval Rd., San Angelo, TX (US) 76904; John Adam Meyers, 106 Spring Mist Pl., The Woodlands, TX (US) 77381

( * ) Notice: Subject to any disclaimer, the term of this patent is extended or adjusted under 35 U.S.C. 154(b) by 179 days.

(21) Appl. No.: 10/718,167

(22) Filed: Nov. 20, 2003

Related U.S. Application Data

(60) Provisional application No. 60/427,775, filed on Nov. 20, 2002.

(51) Int. Cl.
*E21B 31/18* (2006.01)

(52) U.S. Cl. ..... 166/99; 175/246; 175/309

(58) Field of Classification Search ..... None
See application file for complete search history.

(56) References Cited

U.S. PATENT DOCUMENTS

| | | | |
|---|---|---|---|
| 412,447 | A | 10/1889 | Archbold |
| 4,474,488 | A | 10/1984 | Pinkerton et al. |
| 4,726,429 | A | 2/1988 | Kennedy |
| 5,065,827 | A | 11/1991 | Meyers et al. |
| 5,390,749 | A | 2/1995 | Lyon |
| 5,647,447 | A | 7/1997 | Jones |
| 5,699,867 | A | 12/1997 | Jones |
| 5,803,192 | A | 9/1998 | Holte |
| RE36,002 | E | 12/1998 | Elsby et al. |
| 6,021,856 | A | 2/2000 | Pascale |
| 6,070,678 | A | 6/2000 | Pascale |
| 6,516,903 | B1 | 2/2003 | Rogers |

FOREIGN PATENT DOCUMENTS

| | | |
|---|---|---|
| WO | WO 98/05476 | 2/1998 |

*Primary Examiner*—Zakiya W. Bates

(57) ABSTRACT

A bit retention apparatus for the use of retrieving the hammer bit in cases of shankage. The apparatus incorporates a dual sleeve design that fits over the chuck and the extended head section of the hammer bit. The first, "inner" sleeve has two or more ring pieces that fit onto the chuck and have the retention ring fitted into the lower section of the sleeve. The second, "outer" sleeve fits onto the chuck over the inner sleeve to provide protect to the inner sleeve while pulling the shanked bit out of the well bore. Attachment to the bit is accomplished by collars, knobs, or threads on the interior of the sleeves that correspond with holding bands, retention rings, or threads on the bit and chuck.

6 Claims, 6 Drawing Sheets

PERCUSSION HAMMER BIT RETAINER APPARATUS

This application is based upon and claims priority from U.S. Provisional application Ser. No. 60/427,775, filed Nov. 20, 2002, which is incorporated herein by reference.

BACKGROUND OF THE INVENTION

1. Field of the Invention

Applicants' invention relates to the general field of downhole air hammers, also known as percussion drills, but also can be used in the fluid drilling sector when using the hammer assembly. More particularly, it relates to a bit retention apparatus designed to retain and retrieve a broken bit when breakage or "shankage" of the bit shaft occurs. The apparatus retains the broken bit and significantly decreases the chance of losing the broken bit while pulling the drill string out of the well bore.

2. Background Information

When using the percussion drilling assembly, bits can and may be broken due to the high energy levels and rotational torque loads they experience when in use. Along with these two stresses, metal fatigue can be a factor due to the constant impact of the percussion drilling tool. These catastrophic failures often lead to "fishing" jobs which use expensive techniques to retrieve the broken bit from the well bore. Often in these cases, the well bore must be cemented and additional costly measures used to go around the bit left in the hole.

The drill bit is of the type that has larger head section (including a cutting face) at one end; a smaller shank/shaft section on the other end that is used to mate with the Driver sub which delivers rotational energy from the drill string to the bit via splines; and a retaining means for holding the drill bit head to the percussive hammer between the two ends. The standard hammer bit features an external threaded section located just above the head section on the hammer bit. This thread is used when breakage of the bit occurs but still results in a fishing operation to retrieve the bit head. In order to retrieve this bit, one must attempt to "screw" a matching tool over the threaded area for means of retrieving the bit. This method is not only unpredictable, but still results in added expense to the operation.

Once the broken bit is "screwed on," drawing the broken bit from the well bore can still be a problem. Irregular geographical formations and soil/rock texture can cause the bit to twist and allow the possibility of the bit "unscrewing" while being pulled out of the hole. Thus, similar results can occur even once the threaded bit is attached. This can also happen with current retention systems that incorporate a bit that is pre-screwed on to the shank.

Not only do these above mentioned possibilities exist, other problems can also prevent the broken bit from being pulled out of the hole. For example, due to the abrasive characteristics of the geological formations being drilled through, current retention devices can experience washouts to the retention systems. If abrasion causes the retention device to fail, then the chances of retrieving the broken portion of the bit head reduces over time.

These patented ideas have been utilized in the case of retrieving the broken bit but each has flaws in the design.

In the U.S. Pat. No. 5,065,827 (Meyers, et. Al.), the threaded sleeve has been used for such drilling operations but due to the design concept, the broken bit has been "unscrewed" or "pulled" out of the tool while pulling out of the well bore. The percussion drilling tool is mainly used in deviation control and the possibility of the well bore being "cork screwed" can "unscrew" the broken bit from this system due to the string rotating even while chaining out of the hole. The term chaining out of the hole describes the tripping system where the drill string is being pulled with the table locked to prevent the turning, of the drill string. All rotation of the drill string takes place on the pipe being set back so as to remove it from the well bore. The remaining drill string is thus in suspension unable to move due to the power of the rig.

U.S. Pat. No. 4,726,429 (Kennedy; Feb. 23, 1988) describes a retention device which utilizes an extended driver sub and ball bearing mechanism to retain the bit head to the hammer.

U.S. Pat. No. 5,065,827 (Meyers et al; Smith international; 1991) utilizes a "Screw-On" version bit retention system which shows that the bit head could be retained by a external sleeve that was trapped between the Driver Sub (lower sub that has splines to mate with the bit shank for transmitting the torque of the drill-string to rotate the bit) and the hammer housing on its upper end and was threaded to/below the bit head's retaining thread. This first design has the limitation in that it is possible for the bit head to unscrew from the retainer during the trip out of the hole and thus allow the bit head to fall back to the bottom of the hole.

U.S. Pat. Nos. 5,647,447 and 5,699,867 (Jones; Ingersol-Rand; 1997) utilize a similar retaining sleeve (wear collar) that was trapped between the driver sub and hammer housing on the upper end and was attached to the bit on its lower end by a flexible retaining member (snap ring) that was removable from the assembly. This design had more of a positive retention capability of the Meyers design (above) but is difficult to assemble and disassemble in field applications.

WO Patent # 98/05476 (Moir & McInnes; SDS Digger; 1998) utilizes several split sleeve retainer designs that are also attached between the driver-sub and hammer housing on its upper end and below the bit circumferential shoulder on its lower end. These split retainers may be supported by an additional outer ring and/or sleeve to prevent the split sleeves from moving radially away from the circumferential retaining shoulder. In addition, this patent also shows a combination retainer sleeve and driver sub with extended fingers design which is assembled through milled slots in the retaining shoulder. The milled slots are used to allow assembly and to also prevent rotation of the bit to a position of which the retainer lugs will drop through the milled slots in the retaining shoulder.

U.S. Pat. No. 6,070,678 (Pascale; Numa Tool Co.; Jun. 6, 2000) utilizes a retainer sleeve which is attached between the driver-sub and hammer housing on its upper end and slides past the bit retaining shoulder. After the lower section of the retainer is in position below the bit retaining shoulder, pins are driven into the retainer which effectively prevent the retainer sleeve from moving up past the bit's retaining shoulder. These pins are "fixed" to the retainer until disassembly.

An additional patent for a retention system includes U.S. Pat. No. 6,021,856 (Pascale, Jack H.). While each of the above is unique in design, none of these provide the features of the current invention.

Thus, there is a need for a device for retaining and retrieving broken percussion drill bits. Further, it is advantageous for such a device to make connecting to the broken piece easy by retaining a connection, have a means for resisting disconnecting, and protecting the assembly as it is removed from the hole.

SUMMARY OF THE INVENTION

Percussion drill bits are used to drill holes in the earth and are normally retained within the hammer by means of a pair of split rings which are located within recesses of the small end or bit shank area. The bit shank area is subject to the high stresses from the impact of the hammer piston as well as torsional loads from the rotation of the drillstring. Because of these high stresses and the dimensional limitations of the shank, in order to fit into the hammer's internal radius, the small/shank end of the bit is often the area of the bit that breaks.

Most often the fracture surface is below the pair of split retaining rings which are normally positioned in the upper section of the shank area, so without an additional and/or lower retaining mechanism, the bit head is lost in the hole and must be retrieved in order to continue the drilling process. Retrieving the bit head from the bottom of the hole is expensive and difficult.

The first embodiment of the bit retention apparatus of the current invention is referred to as a dual sleeve retention ("DSR") system. The DSR system provides protection against the described extreme conditions and occurrences. The DSR system not only provides both a primary, or inner, retainer sleeve, and a secondary, or outer, retainer sleeve. The inner retainer sleeve remains connected to, or catches, the bit when the bit breaks. The outer protective sleeve provides protection against the side walls of the hole to prevent washing of the inner retainer sleeve. In this manner, a broken bit is retained, and can be retrieved while being protected from the extreme conditions found down-hole.

As described above, numerous devices for the general purpose of retaining and recovering broken bits exist, but none of these systems provide the extra protection of the DSR system as described by the current invention. The bit retention apparatus provides a system where extreme over-pull and unthreading of broken bit is greatly reduced. The bit retention apparatus of the current invention fits, or can be adapted to fit, virtually any downhole percussion drill bit.

The current invention incorporates the concept of using the drill's chuck, which is placed over the splined bit. If it is not originally made with one, the chuck can be re-machined to have a holding band engage the bit retention device if the chuck was not intended for use with the present invention. Exterior splines on the bit mesh with inner splines in the chuck, and the chuck slides on to the bit such that a second shoulder of the chuck holding band rests against the first shoulder of a bit retaining ring. The first shoulder of the chuck holding band, adjoins the inner retention system's internal shoulder when it is attached.

The inner retainer sleeve is actually made from two or more pieces that are placed around the bit and chuck to form a nearly continuous sleeve. The inner retainer sleeve pieces are placed against the first shoulder of the chuck holding band, and a band is used to secure the sleeve pieces together during makeup of complete bit retention assembly. Generally, the band is anticipated to be an o-ring or an elastic strip, but any strap that secures the sleeve pieces and allows for makeup of the complete bit retention assembly may be used.

Between the retaining ring and the cutting end of the bit is a recessed portion of the bit referred to as the bit extended portion. It allows the third shoulder of the inner retainer sleeve to rest during operation of the bit. Like the chuck, if the bit was not originally intended for use with the present invention, the extended portion of the hammer bit can be machined to allow insertion of the third shoulder of the inner sleeve.

A retaining ring between the extended portion of the hammer bit and the splined area in which the chuck sits when in make up mode or during drilling operation, engages the chuck holding band. The retaining ring cannot be removed as it is a machined part of the hammer bit. It has the second shoulder of the chuck holding band urged against it, and in turn, the first shoulder of the inner retainer sleeve is held from sliding off of the bit by the chuck holding band. If there is a breakage of the bit, then as the broken bit is pulled from the hole, the first shoulder of the inner retainer sleeve is engaged against the first shoulder of the chuck holding band.

The outer protective sleeve is placed over the inner retainer sleeve that has been secured to the chuck and hammer bit. The outer protective sleeve is engaged with the inner retainer sleeve such that the first shoulder of the outer protective sleeve is urged against the second shoulder of the inner sleeve. Using matching threads or a like attachment system, the outer protective sleeve can be tightened up to the cylinder of the drill so that all components of the bit retention apparatus are properly secured to the bit.

Once the bit retention apparatus is in place, the bit can be used normally in its operation. While the drill string is lowered into the hole, the bit is in a non-operating mode, extended, fully open and off bottom. As the bit contacts the bottom of the well bore, the bit will then travel inside the chuck and lower end of the percussion tool so as to set the internal working parts of the drill in the working mode. In this cycling mode of the tool, energy is delivered to the bit via an internal moving piston. The energy is then transmitted into the rock/soil formation in order to commence actual drilling operations. Once the bit retention device is in place, it allows the bit to travel and function without any hindrance.

This invention addresses the problem of drill bit retention after breakage occurs in the smaller shank/shaft section of the bit body. The invention describes a bit retention means which secures the percussive hammer to the bit head while also allowing the bit to move in and out of the hammer which starts and stops the hammer's operation. The invention will find applications on numerous styles of percussive hammers which may be of direct, reverse and/or multiple fluid circulation types.

Therefore, it is the object of this invention to position a retaining mechanism in the larger head section (below the shank area) of the bit in order to retain the bit head after most failures occur. It is also the object of this invention to minimize the chance of the bit head from being dropped during the trip out of the hole.

The described details of the bit retention apparatus as noted in the above paragraphs will be more fully understood with the attached drawings. These drawings and detailed description will and should prove the benefits of this unique retention system to the percussion drilling industry.

DETAILED DESCRIPTION OF THE PREFERRED EMBODIMENT

Figure 1:
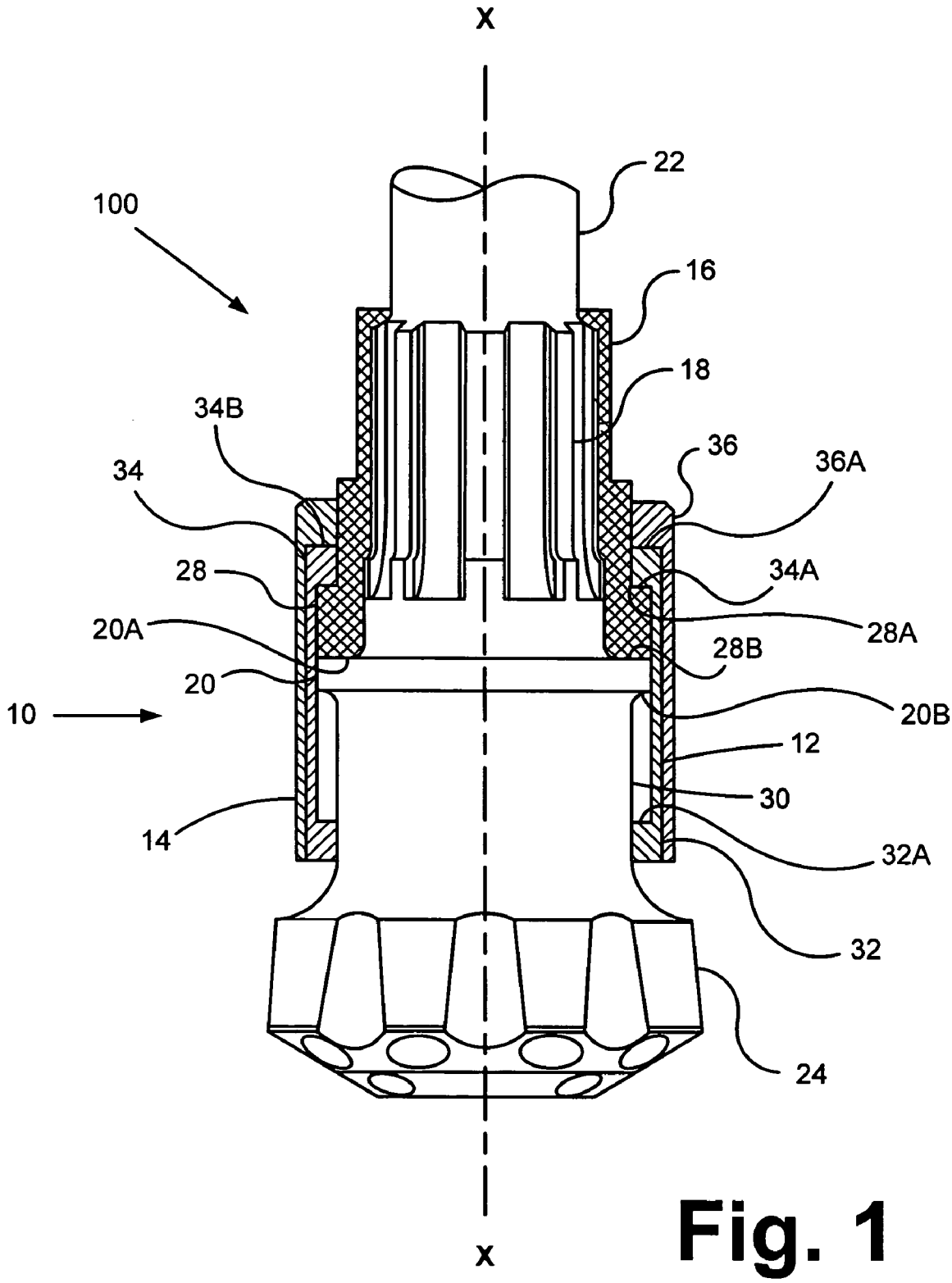
FIG. 1. is a partial sectional view of the bit and the retainer assembly.

FIG. 1. is a partial sectional view of a first embodiment of the bit 100 and the retainer assembly 10. It illustrates orientation of the inner retainer sleeve 12 and outer protective sleeve 14 in relation to the bit 100. The anticipated breakage area of the bit shaft 22 lies between the bit splines 18 and the retaining ring 20. Therefore, in order to retain the bit cutting end 24 if shankage of the bit shaft 22 occurs, the inner retainer sleeve 12 is placed about the bit shaft 22. (As used herein, "downward" means in the direction toward the bit cutting end 24 along the bit shaft 22 and central axis X—X, while "upward" means in the direction away from the bit cutting end 24 along the bit shaft 22 and central axis X—X.)

The inner retainer sleeve 12 is a hollow, generally cylindrically shaped device. Retention is accomplished because the inner retainer sleeve 12 has a first collar 32 and a second collar 34 at its opposite ends. The collars 32 & 34 extend inwardly from the inner retainer sleeve 12, thereby having smaller radiuses than that of the inner retainer sleeve 12. (As used herein, "radius" means the distance from the central axis X—X of the bit shaft 22 to the point or surface described.) The first recessed area is created by the chuck 16, which has a chuck holding band 28 at one end. The chuck 16 is a hollow, generally cylindrically shaped device with internal splines (not shown) that mesh with external splines 18 along the bit shaft 22. The chuck 16 is placed on the bit shaft 22 with the chuck holding band 28 circumscribing the bit shaft 22 and urged against the retaining ring 20 of the bit shaft 22. The retaining ring 20 circumscribes, and is attached to, the bit shaft 22. The meshing of the internal splines of the chuck (not shown) and the external splines 18 of the bit shaft 22 keeps the chuck 16 from sliding off of the bit 100. The outer radius of the chuck holding band 28 is greater than the inner radius of the inner retainer sleeve second collar 34, but less than the inner radius of the inner retainer sleeve 12. The outer radius of the retaining ring 20 is greater than the inner radius of the inner retainer sleeve first collar 32, but less than the inner radius of the inner retainer sleeve 12. The length of the inner retainer sleeve 12 will generally be such that the inner retainer sleeve second collar 34 fits above the chuck holding band 28, while the inner retainer sleeve first collar 32 fits below the retaining ring 20. However, it is anticipated that the length of the internal sleeve 12 can be fitted to the entire length of the bit bore (not shown). Therefore, if breakage occurs in the expected area, any upward force on the bit cutting end 24 holds the bit cutting end 24 against the remaining bit shaft 22. Conversely, any downward force pulls the retaining ring second shoulder 20*b* against the inner retainer sleeve first collar shoulder 32*a* and the chuck holding band first shoulder 28*a* against the inner retainer sleeve second collar first shoulder 34*a*. Because the chuck 16 with its holding band 28 and the retaining ring 20 are both secured to the different pieces of the broken bit shaft 22, the inner retainer sleeve 12 acts to retain the bit cutting end 24 as the bit 100 is drawn out of the well bore (not shown).

While the bit 100 is being drawn out of the well bore (not shown), the inner retainer sleeve 12 would generally be subjected to abrasive and rotational forces due to the upward movement and various geological formations it passes through. Therefore, to protect the inner retainer sleeve 12 from these forces, an outer protective sleeve 14 is placed about the inner retainer sleeve 12. The outer protective sleeve 14 is a hollow, generally cylindrically shaped device whose length is generally anticipated to be roughly the same as the length of the inner retainer sleeve 12. It has a rim 36 at one end whose inner radius is less than the inner radius of the outer protective sleeve 14. The inner radius of the outer protective sleeve 14 is sized slightly larger than the outer radius of the inner retainer sleeve 12, such that the outer protective sleeve 14 fits closely about the inner retainer sleeve 12. The inner radius of the outer protective sleeve rim 36 is less than the outer radius of the inner retainer sleeve 12 (and may often be similar to the inner radius of the inner retainer sleeve second collar 34). Thus, as the bit 100 is being pulled from the well bore (not shown) the outer protective sleeve rim shoulder 36*a* is urged against the inner retainer sleeve second collar second shoulder 34*b*, and the outer protective sleeve 14 remains in place about the inner retainer sleeve 12. The outer protective sleeve 14 may be held in place on the chuck 16 by meshing threads (not shown) on the inner surface of the outer protective sleeve rim 36 and on the outer surface of the chuck 16.

Figure 2A:
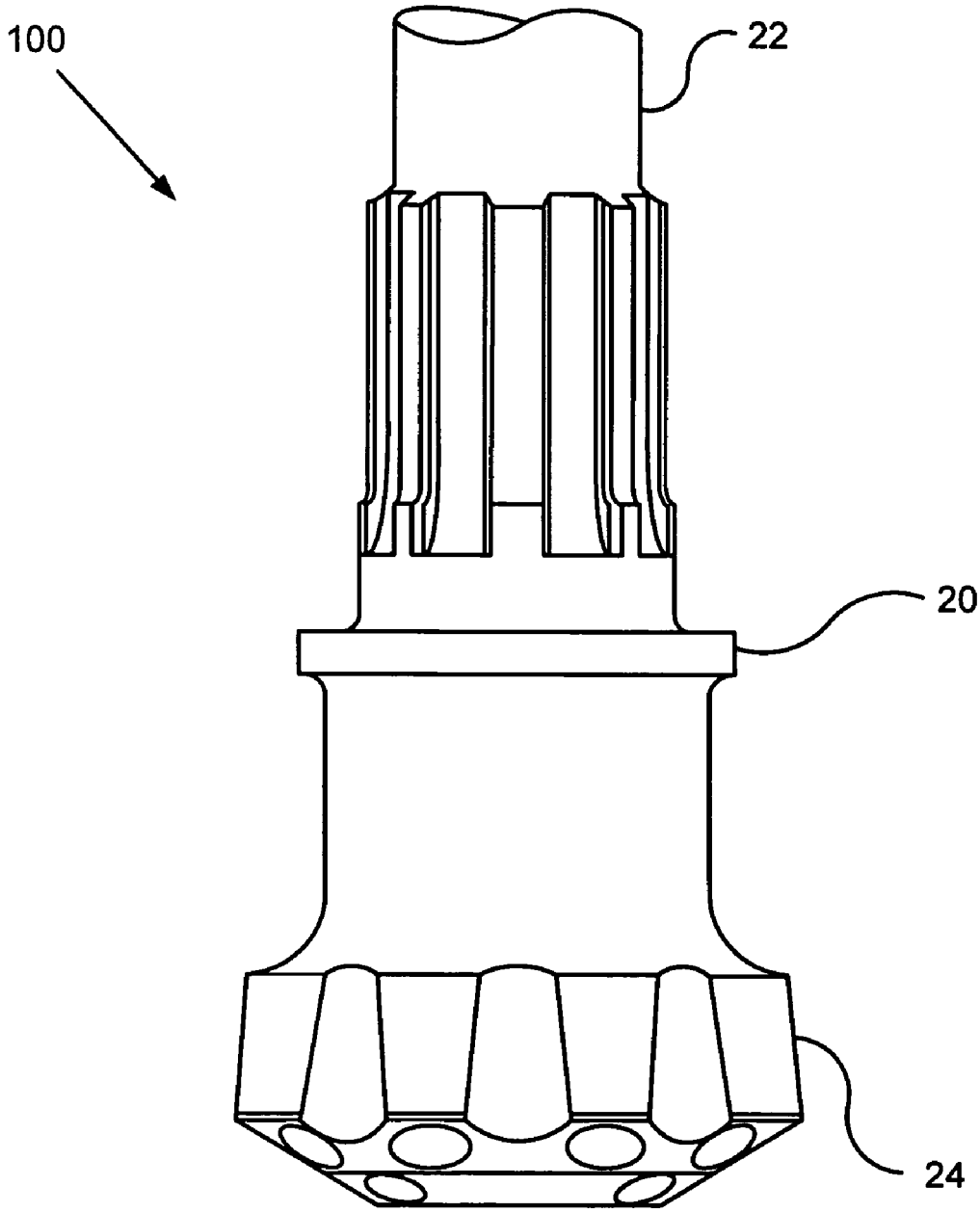
FIG. 2*a*. is front elevational view of a bit.

FIG. 2*a*. is front elevational view of a bit 100. The stem portion of the bit 100 to which the retaining ring 20 is shown. Prior to installation of the bit retention apparatus 100, the bit shaft 22 and the retaining ring 20 should be examined and measured for purposes of identifying the inner retainer sleeve 12 dimensions.

Figure 2B:
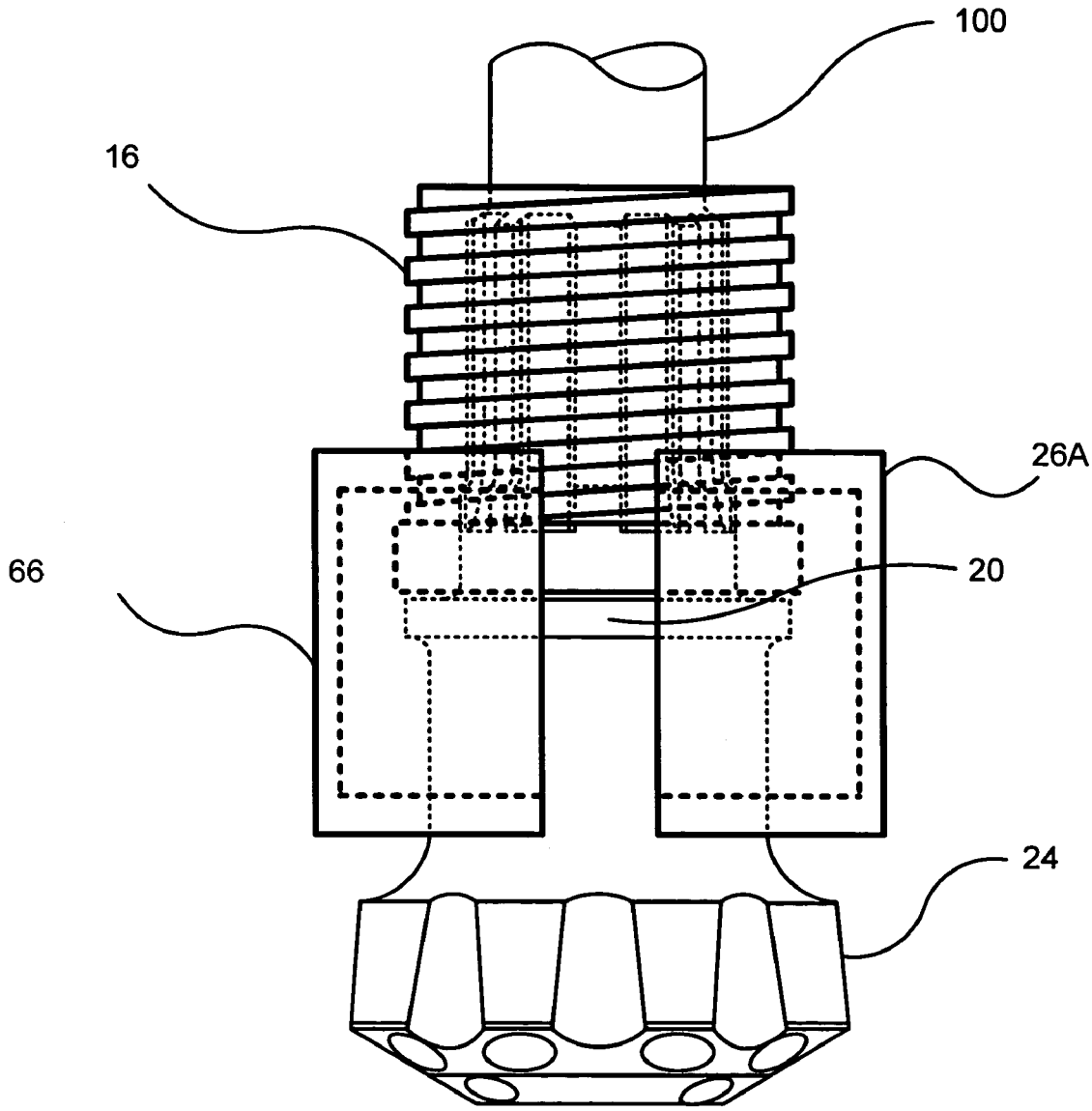
FIG. 2*b*. is front elevational view of a bit, with the chuck and inner retainer sleeve attached.

FIG. 2*b*. is front elevational view of a bit 100, with the chuck 16 and inner retainer sleeve 12 attached. The internal splines (not shown) of the chuck 16 match to external bit splines 18 (FIG. 1.). As the chuck 16 is slid down over the bit splines 18, it will rest on the retaining ring first shoulder 20*a* (FIG. 1.). The retaining ring 20 is below the bit splines 18 and above the bit extended portion 30 (FIG. 1.). The chuck 20 is firmly engaged on the bit 100. The inner retainer sleeve 12 is comprised of two or more pieces, shown in this figure as the first inner sleeve piece 26*a* and the second inner sleeve piece 26*b*. The first inner sleeve piece 26*a* and the second inner sleeve piece 26*b* are placed on the outside of the chuck 16, around the outside of the bit 100. In this figure, the first inner sleeve piece 26*a* and the second inner sleeve piece 26*b* of the inner retainer sleeve 12 are illustrated as partially applied to the chuck 16 and bit 100. In the completed assembly of the bit retention apparatus 10, the inner sleeve pieces 26*a* & 26*b* are pressed together such that they form a nearly continuous inner retainer sleeve 12. Once the first inner sleeve piece 26*a* and the second inner sleeve piece 26*b* are in place around chuck 16 and bit 100, a band (not shown) is used to secure the sleeve pieces 26*a* & 26*b* together during the assembly of the bit retention apparatus 10. Often an o-ring is used for the band (not shown), which is placed around the upper portion of the inner retainer sleeve 12. After the sleeve pieces 26*a* & 26*b* are secure and located correctly on the bit 100, the outer protective sleeve 14 is ready for placement.

Figure 2C:
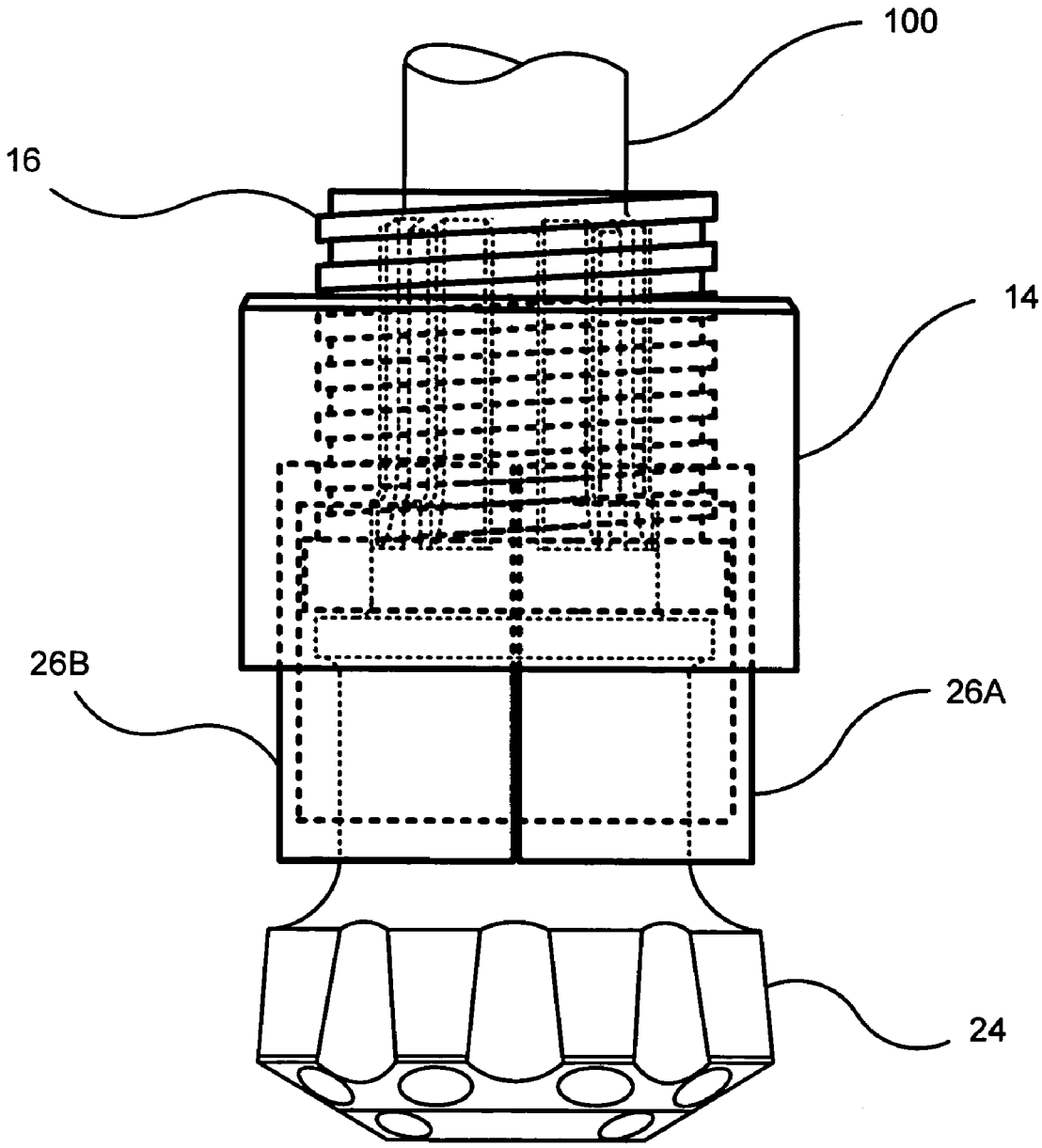
FIG. 2*c*. is front elevational view of a bit, with the chuck, inner retainer sleeve, and outer protective sleeve attached.

FIG. 2*c*. is front elevational view of a bit 100, with the chuck 16, inner retainer sleeve 12, and outer protective sleeve 14 attached. Upon completing the above mentioned steps, the outer protective sleeve 14 is placed over the inner retainer sleeve 12 and slid down to the external threads (no reference number) on the chuck 16. As the threads (not shown) are matching on the inner side of the outer protective sleeve 14, the outer protective sleeve 14 may be rotated until it falls free of the chuck threads (no reference number). The outer protective sleeve 14 is then urged against the inner retainer sleeve second collar second shoulder 34*b*.

The installed bit retention apparatus 10 is shown in this figure. In this configuration, the bit 100, chuck 16 and bit retention apparatus 10 are ready for attachment to the percussion drilling tool (not shown). Attachment to the percussion drilling tool (not shown) includes the proper tightening of the chuck 16 to the drilling tool (not shown), during which the outer protective sleeve rim 36 will act as an anchor against which torque is applied. After the bit 100, chuck 16 and bit retention apparatus 10 are fully installed and all items are torqued, the drill (not shown) is ready for use. The bit retention apparatus 10 takes no part in, and does not hinder or affect the drilling process. The bit retention apparatus 10 is only utilized when breakage of the bit 100 occurs, and helps prevent the bit 100 from being left downhole.

Figure 3:
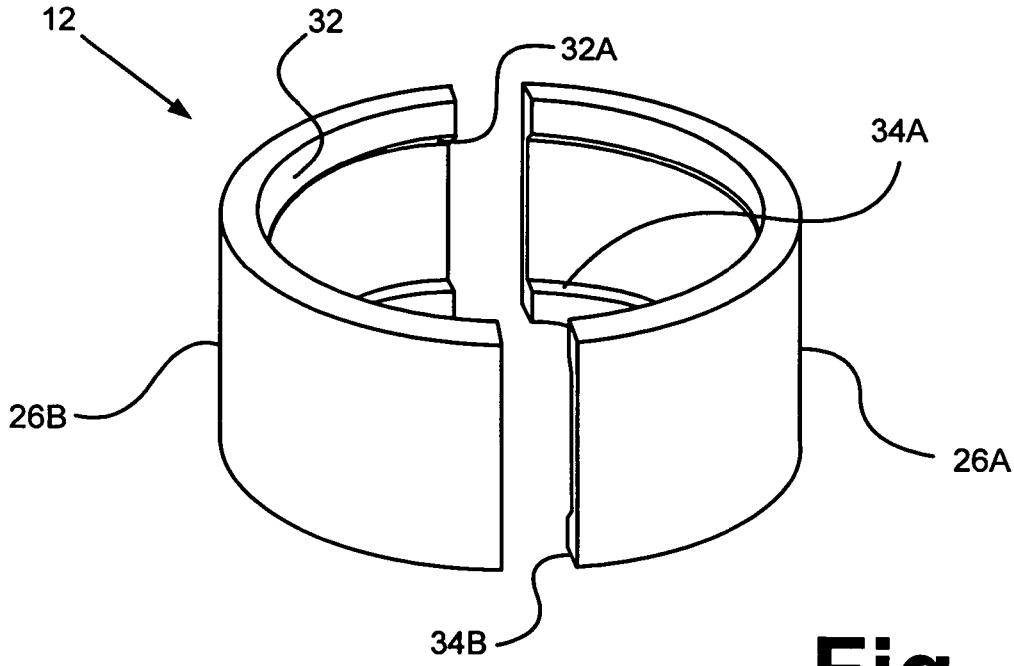
FIG. 3. is a perspective view of the inner retainer sleeve.

FIG. 3. is a perspective view of the inner retainer sleeve 12. This picture shows the inner retainer sleeve 12 in a first embodiment comprised of two members, a first inner sleeve piece 26*a* and a second inner sleeve piece 26*b*. The inner retainer sleeve first collar 32 with its shoulder 32*a* are shown with the inner radius of the inner retainer sleeve first collar 32 being less than the inner radius of the inner retainer sleeve 12. The inner retainer sleeve second collar 34 with its first shoulder 34*a* and its second shoulder 34*b* are shown with the inner radius of the inner retainer sleeve second collar 34 being less than the inner radius of the inner retainer sleeve 12. The inner retainer sleeve 12 may be sized to fit any size hammer bit 100.

Figure 4:
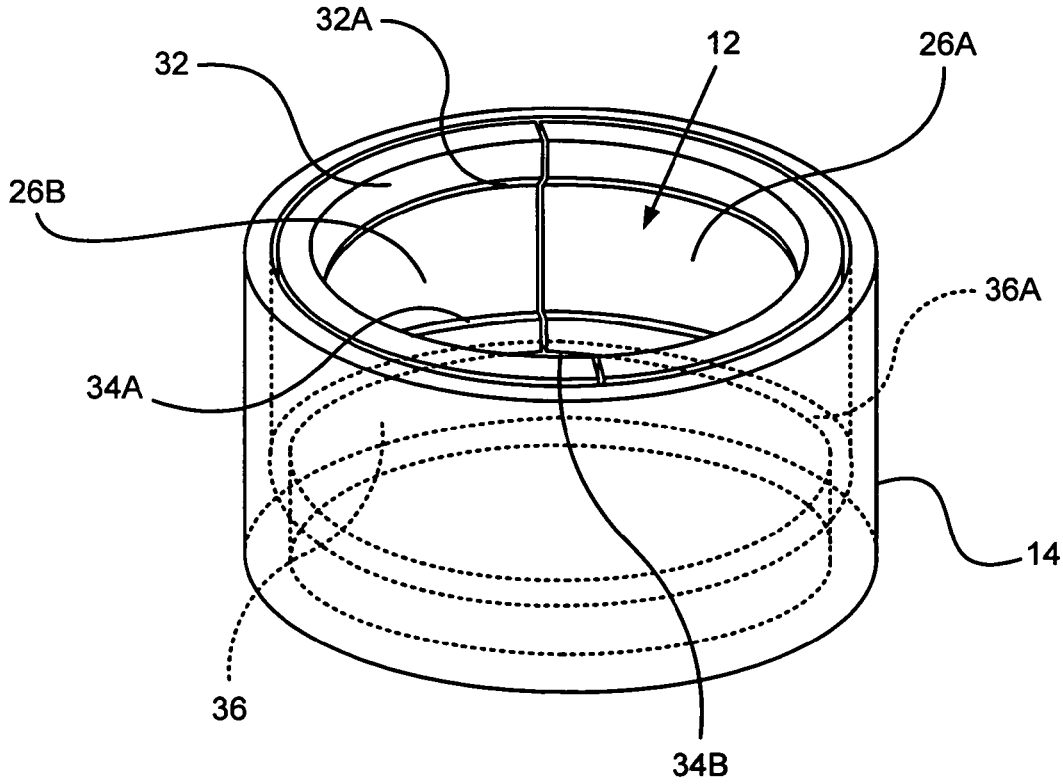
FIG. 4. is a perspective view of the inner retainer sleeve and outer protective sleeve.

FIG. 4. is a perspective view of the inner retainer sleeve 12 and outer protective sleeve 14. Note that for clarity, the dashed lines in the figure only represent the outer protective sleeve rim 36, and do not indicate the inner retainer sleeve second collar 34. The sleeves 12 & 14 are anticipated to be made of the same or similar material from which the percussion tool (not shown) is manufactured. This material is a heat treated and hardened steel that will withstand the extreme environment in which it is introduced, but strong enough to retrieve the broken bit 100. However, application of the bit rentetion apparatus 10 may recommend different materials. This figure shows the inner retainer sleeve 12 and outer protective sleeve 14 as they fit once they are properly secured. The inner retainer sleeve second collar second shoulder 34*b* is shown urged against the outer protective sleeve rim shoulder 36*a*. The inner sleeve pieces 26*a* & 26*b* are surrounded by the outer protective sleeve 14, making an almost continuous inner retainer sleeve 12. As described, the inner retainer sleeve 12 acts to retain the broken off bit cutting end 24 as it is pulled from the well bore, while the outer protective sleeve 14 protects the inner retainer sleeve 12 from envirnmental forces.

Figure 5:
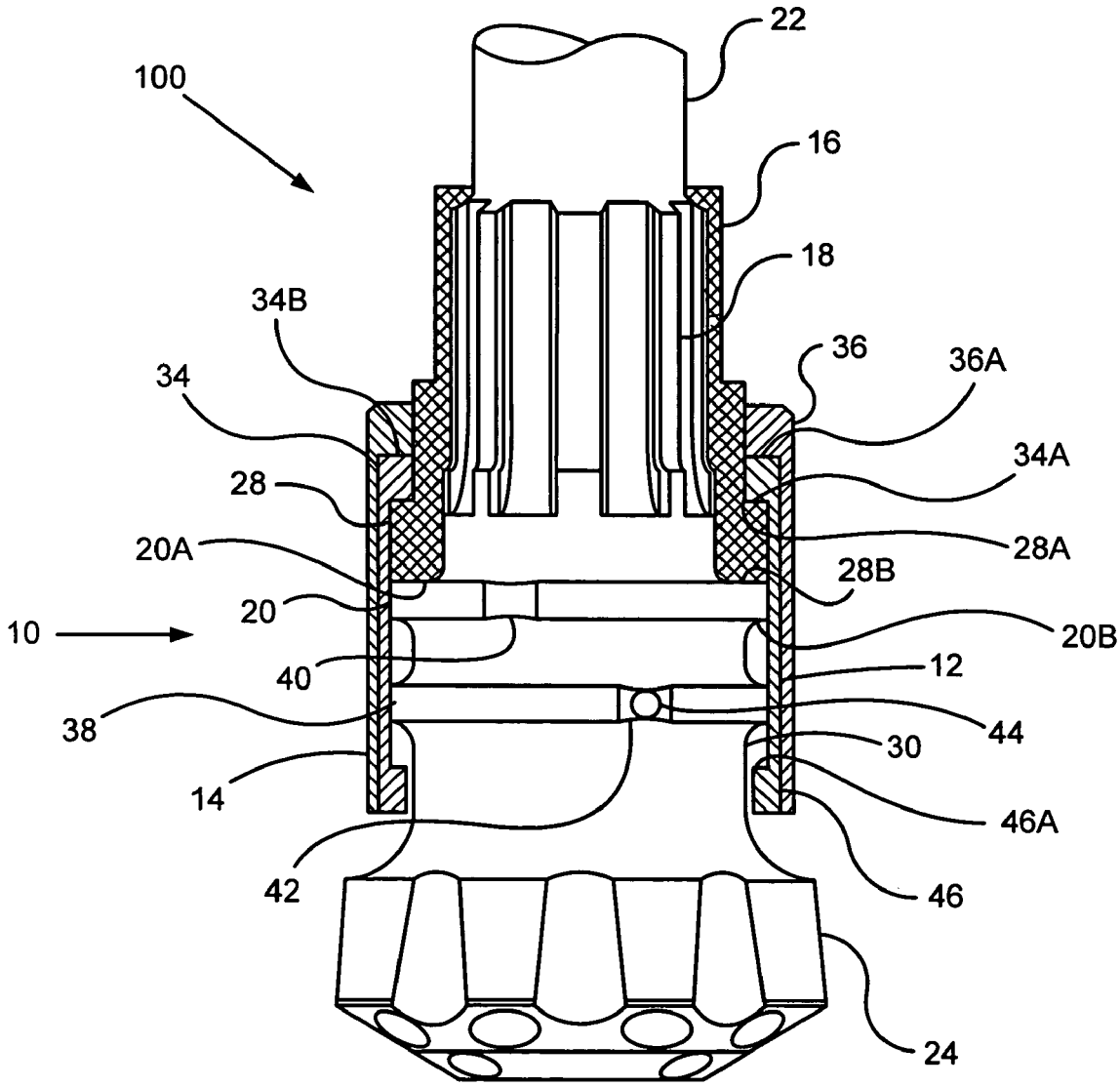
FIG. 5. illustrates a second embodiment of the bit retention apparatus.

FIG. 5. illustrates a second embodiment of the bit retention apparatus 10. In this second embodiment the bit 100 has the retaining ring 20 and a second retaining ring 38. The retaining ring 20 is not continuous about the bit shaft 22, and has a first slot 40 in it. Likewise, the second retaining ring 38 has a second slot 42 in it. The inner retainer sleeve 12 is modified from the first embodiment such that the first collar 32 is not a continuous ring about the interior of the inner retainer sleeve 12 as shown in FIG. 3. Instead, the first collar 32 is compressed into a knob 46 that is sized to fit through slots 40 & 42. The retaining ring 20 and the second retaining ring 38 may each have multiple slots 40 & 42 located around their circumferences. Likewise, there may be multiple knobs 46. The bit retention apparatus 10 is assembled to the bit 100 by sliding the first collar knob 46 through the slots 40 & 42 until the first collar knob 46 extends below the second retaining ring 38. The knob 46 has an inner radius less than the outer radius of the retaining rings 20 & 38. The inner retainer sleeve 12 is then twisted such that if the bit 100 breaks and there is downward force exerted on the bit cutting end 24, the first collar knob shoulder 46*a* is urged against the second retaining ring second shoulder 38*b* and the bit cutting end 24 is held as it is drawn from the well bore. In order to limit the chance of the bit cutting end 24 rotating as it is drawn from the well bore and having the first collar knob 46 slide back through the slots 40 & 42 thereby releasing the broken bit cutting end 24, it is anticipated that the slots 40 & 42 will be offset. Further decreasing the chance of the first collar knob 46 sliding back through the slots 40 & 42, multiple slots 40 & 42 and multiple knobs 46 may be located such that the inner retainer sleeve 12 only passes the retaining rings 20 & 38 in a specific position. Further decreasing the chance of the first collar knob 46 slide back through the slots 40 & 42, after the first collar knob 46 is assembled through the slots 40 & 42, a blocking member 44 may be attached to the bit shaft 22 within the slots 40 & 42 such that the first collar knob 46 cannot slide back through the slots 40 & 42. Alternatively, the blocking member 44 may be attached to the bit shaft 22 in such a position as to stop the broken bit cutting end 24 from rotating.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. An apparatus for retrieving a broken, down-hole bit having a cutting end comprising:

a hollow, generally cylindrical inner retainer sleeve having a collar and a knob positioned at opposite ends of said inner retainer sleeve;

a holding band attached to and circumscribing said bit;

a first retaining ring attached to and circumscribing said bit, said first retaining ring positioned closer to said cutting end than said holding band is positioned, and said first retaining ring having a first slot;

a second retaining ring attached to and circumscribing said bit, said second retaining ring positioned closer to said cutting end than said holding band is positioned, and said second retaining ring having a second slot;

said inner retainer sleeve having a larger inner radius than the outer radiuses of said first and second retaining rings and said holding band;

said collar having a smaller inner radius than the outer radius of said holding band;

said knob having a smaller inner radius than the outer radius of said first and second retaining rings;

said knob sized to fit through said first and second slots; and said inner retainer sleeve attachable around said bit with said knob below said first and second retaining rings and said second collar above said holding band.

2. An apparatus for retrieving a broken, down-hole bit having a cutting end comprising:

a hollow, generally cylindrical inner retainer sleeve having a collar and a knob positioned at opposite ends of said inner retainer sleeve;

a holding band attached to and circumscribing said bit;

a first retaining ring attached to and circumscribing said bit, said first retaining ring positioned closer to said cutting end than said holding band is positioned, and said first retaining ring having a first slot;

a second retaining ring attached to and circumscribing said bit, said second retaining ring positioned closer to said cutting end than said holding band is positioned, and said second retaining ring having a second slot;

said inner retainer sleeve having a larger inner radius than the outer radiuses of said first and second retaining rings and said holding band;

said collar having a smaller inner radius than the outer radius of said holding band;

said knob having a smaller inner radius than the outer radius of said first and second retaining rings;

said knob sized to fit through said first and second slots;

said inner retainer sleeve attachable around said bit with said knob below said first and second retaining rings and said second collar above said holding band; and wherein said first and second slots are offset.

3. The apparatus of claim 2, further comprising a hollow, generally cylindrical outer protective sleeve having a rim positioned at one end of said outer protective sleeve;

said outer protective sleeve having a larger inner radius than the outer radius of said inner retainer sleeve;

said rim having a smaller inner radius than the outer radius of said holding band; and said outer protective sleeve generally position positioned around said inner retainer sleeve.

4. An apparatus for retrieving a broken, down-hole bit having a cutting end comprising:

a hollow, generally cylindrical inner retainer sleeve having a collar and a knob positioned at opposite ends of said inner retainer sleeve;

a holding band attached to and circumscribing said bit;

a first retaining ring attached to and circumscribing said bit, said first retaining ring positioned closer to said cutting end than said holding band is positioned, and said first retaining ring having a first slot;

a second retaining ring attached to and circumscribing said bit, said second retaining ring positioned closer to said cutting end than said holding band is positioned, and said second retaining ring having a second slot;

said inner retainer sleeve having a larger inner radius than the outer radiuses of said first and second retaining rings and said holding band;

said collar having a smaller inner radius than the outer radius of said holding band;

said knob having a smaller inner radius than the outer radius of said first and second retaining rings;

said knob sized to fit through said first and second slots;

said inner retainer sleeve attachable around said bit with said knob below said first and second retaining rings and said second collar above said holding band; and a blocking member attachable within said first or second slots.

5. The apparatus of claim 4, further comprising a hollow, generally cylindrical outer protective sleeve having a rim positioned at one end of said outer protective sleeve;

said outer protective sleeve having a larger inner radius than the outer radius of said inner retainer sleeve;

said rim having a smaller inner radius than the outer radius of said holding band; and said outer protective sleeve generally position positioned around said inner retainer sleeve.

6. An apparatus for retrieving a broken, down-hole bit having a cutting end comprising:

a hollow, generally cylindrical inner retainer sleeve having a collar and a knob positioned at opposite ends of said inner retainer sleeve;

a holding band attached to and circumscribing said bit;

a first retaining ring attached to and circumscribing said bit, said first retaining ring positioned closer to said cutting end than said holding band is positioned, and said first retaining ring having a first slot;

a second retaining ring attached to and circumscribing said bit, said second retaining ring positioned closer to said cutting end than said holding band is positioned, and said second retaining ring having a second slot;

said inner retainer sleeve having a larger inner radius than the outer radiuses of said first and second retaining rings and said holding band;

said collar having a smaller inner radius than the outer radius of said holding band;

said knob having a smaller inner radius than the outer radius of said first and second retaining rings;

said knob sized to fit through said first and second slots;

said inner retainer sleeve attachable around said bit with said knob below said first and second retaining rings and said second collar above said holding band;

a hollow, generally cylindrical outer protective sleeve having a rim positioned at one end of said outer protective sleeve;

said outer protective sleeve having a larger inner radius than the outer radius of said inner retainer sleeve;

said rim having a smaller inner radius than the outer radius of said holding band; and said outer protective sleeve generally position positioned around said inner retainer sleeve.

* * * * *